United States Patent [19]

Hori et al.

[11] 4,380,195

[45] Apr. 19, 1983

[54] TYPE SETTING DEVICE FOR PRINTERS

[75] Inventors: Fumihisa Hori, Tamayama; Mikio Miyajima, Nishine, both of Japan

[73] Assignee: Alps Electric Co., Ltd., Tokyo, Japan

[21] Appl. No.: 155,147

[22] Filed: May 30, 1980

[30] Foreign Application Priority Data

May 31, 1979 [JP] Japan ..... 54-73643[U]

[51] Int. Cl.[3] ..... B41J 1/24

[52] U.S. Cl. ..... 101/93.17; 101/93.22; 101/99; 101/110

[58] Field of Search ..... 101/93.15, 93.16, 93.17, 101/93.22, 99, 110, 91, 232, 235, 245

[56] References Cited

U.S. PATENT DOCUMENTS

| | | | |
|---|---|---|---|
| 2,766,687 | 10/1956 | Williams | 101/99 |
| 3,039,385 | 6/1962 | Siegel | 101/91 |
| 3,373,851 | 3/1968 | Baer | 192/21 |
| 3,738,264 | 6/1973 | Sobottka et al. | 101/99 X |
| 3,815,497 | 6/1974 | Wallace | 101/91 X |
| 4,054,089 | 10/1977 | Okabe | 101/99 |
| 4,152,982 | 5/1979 | Mikoshiba et al. | 101/93.22 |
| 4,170,937 | 10/1979 | Nakagaki et al. | 101/93.22 X |
| 4,244,291 | 1/1981 | Kodaira et al. | 101/93.17 X |
| 4,258,624 | 3/1981 | Mitsui | 101/99 |

FOREIGN PATENT DOCUMENTS

| | | |
|---|---|---|
| 1930048 | 2/1971 | Fed. Rep. of Germany . |
| 1076363 | 7/1967 | United Kingdom . |
| 2056917 | 3/1981 | United Kingdom . |

*Primary Examiner*—Edward M. Coven

*Attorney, Agent, or Firm*—Guy W. Shoup; Gerard F. Dunne

[57] ABSTRACT

A type setting device for printers, comprising a drive motor, a drive gear mounted on a rotary shaft and rotated by the drive motor, a type wheel having a plurality of type elements and rotatably mounted on the rotary shaft, a first spring clutch interposed between the drive gear and the rotary shaft, a ratchet gear fixedly mounted on the rotary shaft and selectively stopped to control the first spring clutch, and a second spring clutch adapted to prevent the rotary shaft from being rotated reversely with respect to the rotation of the drive gear. The drive gear can thus be kept rotating at all times so that it is unnecessary that the motor be started and stopped every time a character is printed. This allows a high-speed type selection and high-speed printing.

10 Claims, 4 Drawing Figures

TYPE SETTING DEVICE FOR PRINTERS

BACKGROUND OF THE INVENTION

The present invention relates to a type setting device and, more particularly, to a type setting device which permits a drive motor to be constantly rotated.

A printing mechanism for a miniaturized serial printer used for desk calculators or the like generally has a type wheel having a plurality of type elements on its circumferential surface and capable of being moved in the direction of a line to be printed. A mechanism for selecting a particular type element rotates the type wheel so as to set a desired type element in a printing position, and a printing hammer typically having a length equal to the entire line to be printed by the type wheel is supported pivotally and moved by a solenoid.

The type wheel is aligned in position along the line to be printed and rotated to allow a desired type element to be set in a printing position. Recording paper is inserted between the printing hammer and the ink-carrying type element and is pressed against the type element by the hammer to thereby print a character. The type wheel is then moved laterally so as to become aligned with the next place along the printing line, and a printing operation as described above is repeated. Printing operations are thereafter carried out in the same manner repeatedly to print one line of characters.

The type wheel is typically stopped when the recording paper is pressed against a type element by the hammer, so that thin characters or broken files do not occur. In this way, printed characters of a high quality can be obtained. This also allows the hammer to be simply controlled with respect to the timing of the drive of the type wheel.

In a conventional serial printer, the type wheel is directly connected to a shaft of a stepping motor, and the motor is driven by suitable pulses to select a particular type element. Accordingly, it is necessary that the motor be controlled with respect to its starting, rotation and stopping every time one character is to be printed. As a result, it takes a considerably long time to start and stop the motor so that high-speed printing cannot be carried out. Moreover, the motor control circuit is necessarily complicated.

SUMMARY OF THE INVENTION

An object of the present invention is to provide a type setting device which does not require the motor to be stopped during use.

Another object of the present invention is to provide a type setting device which permits a high-speed printing operation in comparison with a serial printer having stationary type elements or a stepping motor.

Still another object of the present invention is to provide a type setting device of a low price using a DC motor, which is suitable for use in a miniaturized printer of the type which may be conveniently mounted in, especially, electronic desk calculators.

To these ends, the present invention includes a type setting device comprising a drive motor, a drive gear actuated by the drive motor, a type wheel supported on a rotary shaft, a first spring clutch interposed between the drive gear and the rotary shaft, a ratchet gear fixedly mounted on the rotary shaft and selectively stopped to control the first spring clutch, and a second spring clutch adapted to prevent the rotary shaft from being rotated reversely with respect to the rotation of the drive gear.

The above and other objects as well as advantageous features of the present invention will become clear from the following description of the preferred embodiment taken in conjunction with the accompanying drawings.

DESCRIPTION OF THE PREFERRED EMBODIMENT

Figure 1:
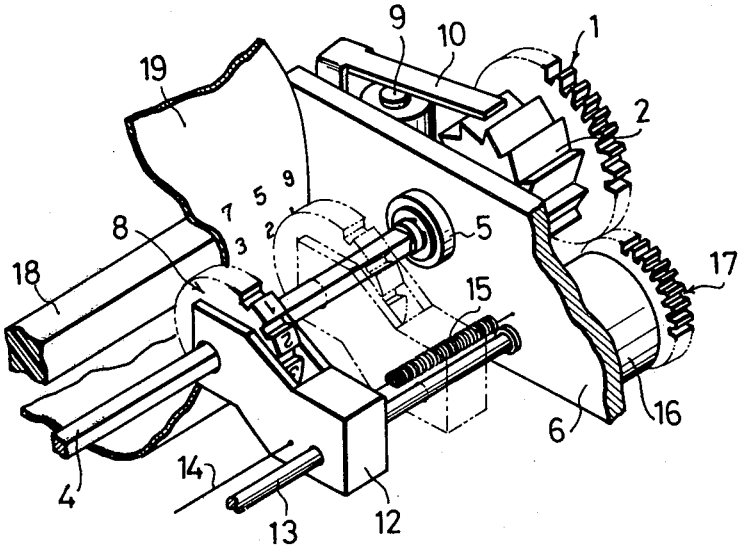
FIG. 1 is a perspective view of a principal portion of a serial printer to which a type setting device according to the present invention is applied.

Referring to FIG. 1, a type wheel 8 is mounted for rotation with a shaft 4 and supported on a carriage 12. The type wheel 8 is provided with a plurality of type elements on its circumferential surface. The carriage 12 is mounted on a guide shaft 13 such that the former can be laterally moved on the latter. A tension thread 14 is fixed at its one end to one side surface of the carriage 12, and a coil spring 15 is fixed at its one end to the other side surface of the carriage 12.

The carriage 12 is actuated by a capstan or the like, now shown, which gradually winds up the tension thread 14 against the resilient force of the coil spring as a printing operation progresses, and releases the tension thread 14 when the printing of one line has been completed, to allow the carriage 12 to be returned by the resilient force of the coil spring 15.

A drive gear 1 is constantly rotated via a gear 17 fixedly mounted on a rotary shaft of a drive motor 16, and the rotary movement of the drive gear 1 is transmitted to a ratchet gear 2 by a spring clutch which will be described later. As a result, the rotary shaft 4 on which the ratchet gear 2 is fixedly mounted is rotated to allow the type wheel 8 to be rotated as well.

When a desired type element on the type wheel 8 is in the printing position, a detection signal is produced by a detection means (not shown) to activate the electromagnetic solenoid 9 so that the control lever 10 comes into engagement with a pawl of the ratchet gear 2 to forcibly stop the rotation thereof.

When the rotation of the ratchet gear 2 is stopped, the spring clutch is actuated to interrupt the operative connection between the drive gear 1 and ratchet gear 2 so the type wheel is stopped with the desired type element opposed to a hammer 18. The hammer is then actuated such that paper 19 is thereby pressed against the type wheel 8, to print a character. Various characters are thereafter printed one by one in the same manner in proper order to complete the printing of one line.

Conventional structures such as an ink feed means, for example, an ink roller and an ink ribbon are omitted in FIG. 1.

Figure 2:
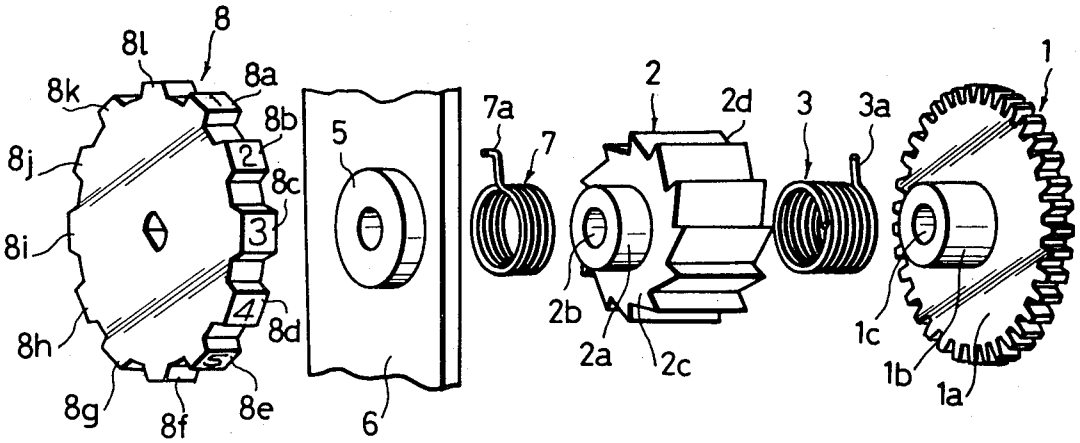
FIG. 2 is an exploded view in perspective of portions of the type setting device shown in FIG. 1.
Figure 3:
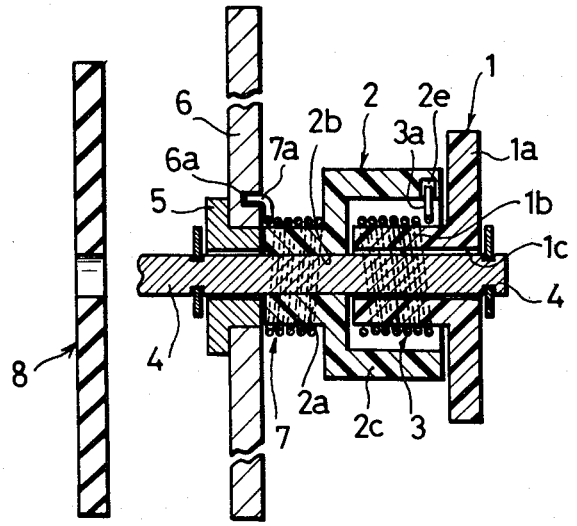
FIG. 3 is a front elevational view in cross section of a type setting device embodying the present invention.

A type setting device according to the present invention will be described more in detail with reference to FIGS. 2–4.

Referring to the drawings, reference numeral 1 denotes a drive gear which is constantly rotated by a gear connected to a motor and which consists of a disc 1a having teeth at the circumferential portion thereof, a hub 1b provided in the central portion of the disc 1a, and a bore 1c formed through the central portion of the disc 1a and hub 1b.

Reference numeral 2 denotes a substantially cup shaped type selection ratchet having a boss 2a in the central portion of the outer surface of the circular wall thereof, a bore 2b formed through the central portion of the ratchet 2 and boss 2a, a cup body 2c, and a plurality of pawls 2d provided on the circumferential surface of the cup body 2c.

Reference numeral 3 denotes a spring clutch which includes a coil spring adapted to be tightened around the hub 1b as the drive gear 1 is rotated, and which is engaged at its one end 3a with a recess 2e provided in the inner circumferential surface of the cup body 2c of the ratchet 2.

Reference numeral 4 denotes a rotary shaft on which the drive gear 1 is freely rotatably mounted. The ratchet 2 is fixedly mounted on the rotary shaft 4 by a pressure fit.

Reference numeral 5 denotes a bearing rotatably receiving the rotary shaft 4, 6 a side plate serving as a support frame for the shaft 4 and into which a central portion 5a of the bearing 5 is inserted to be held therein, and 7 a second spring clutch for the prevention of a reverse rotation of the rotary members. The second spring clutch 7 is engaged at its one end 7a with a recess 6a provided in a part of the side plate 6.

Reference numeral 8 denotes a type wheel which is splined to the rotary shaft 4 so that the type wheel 8 can be rotated with and slidingly moved along the rotary shaft 4. The type wheel 8 carries a plurality of type elements 8a, 8b . . . 8l on the circumferential surface thereof.

Figure 4:
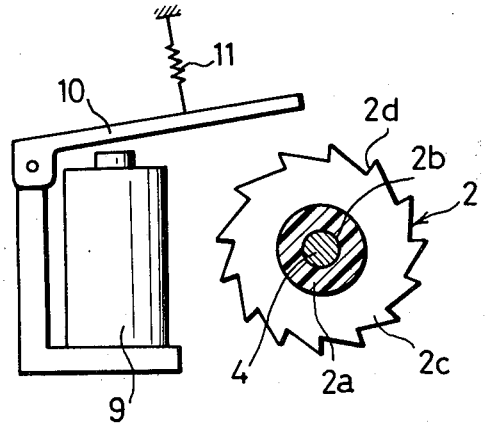
FIG. 4 illustrates the relationship between a ratchet gear and an electromagnetic member in the type setting device shown in FIG. 2.

Reference numeral 9 (refer to FIG. 4) denotes an electromagnetic solenoid for use in selecting type elements. The electromagnetic solenoid 9 is energized to attract a lever 10 to allow the same to come into engagement at its free end with a pawl 2d of the ratchet 2. Reference numeral 11 denotes a spring adapted to return the lever 10 to an upper position when the electromagnetic solenoid 9 is deenergized.

The assembling and a type selection operation of a type setting device according to the present invention will be described.

The ratchet 2 is fixedly mounted by press fit on a predetermined portion of the rotary shaft 4. The second spring clutch 7 is fitted around the leg 2a of the ratchet 2.

The bearing 5 with the central portion 5a thereof inserted in the side plate 6 is mounted on the rotary shaft 4, and one end 7a of the second spring clutch 7 is brought into engagement with the recess 6a provided in the side plate 6. The drive gear 1 with other spring clutch 3 fitted around the boss 1b thereof is then mounted on the rotary shaft 4, and the one end 3a of the spring clutch 3 is brought into engagement with the recess 2e provided in the ratchet 2. Thus, a structure in an assembled state as shown in FIG. 1 is obtained. Incidentally, the type wheel 8 is mounted on the rotary shaft 4 beforehand.

A type selection operation of the mechanism thus assembled will now be described.

When a printing instruction is given, the motor is started, and the motor thereafter continues to be rotated at a predetermined speed until a signal representative of the completion of printing has been generated.

When the motor is started, the drive gear 1 begins to be rotated, and the spring clutch 3 is tightened around the hub 1b. When the spring clutch 3 is rotated as it is tightened, the ratchet 2 and the rotary shaft 4, on which the ratchet 2 is fixedly mounted, are rotated together since the spring clutch 3 is engaged at its one end 3a with the recess 2e in the ratchet 2.

The rotary shaft 4 is provided thereon with a rotary encoder consisting of a slit disc (not shown). The slit disc is provided with a home position slit and a type position indication slit in the peripheral portion thereof.

When information on the position of a type element for a character to be printed (information on the position of the character with respect to the home position) is given by a controller (not shown), the number of slits counted from the home position is detected by a detection means to easily locate the desired type element in the printing position. At the same time that the desired type element is located in the printing position, the electromagnetic solenoid 9 is energized to allow the lever 10 to be attracted thereto so that lever 10 comes into engagement at its free end with a pawl 2d of the ratchet 2. As a result, the ratchet 2 stops being rotated. Accordingly, the rotary shaft 4 also stops being rotated, and a desired type element is selected with the type wheel 8 in a stopped state.

When the ratchet 2 stops being rotated, the spring clutch 3 on the boss 1b is instantly loosened so that the ratchet 2 is released immediately from the hub 1b of the drive gear 1. The rotary movement of the drive gear 1 is thus not transmitted to the ratchet 2 until the electromagnetic solenoid 9 has been deenergized.

While the type wheel is in a stopped state, a printing operation (hammering) is carried out, and the electromagnetic solenoid 9 is thereafter deenergized. The type wheel 4 is then laterally transferred to carry out the same operation repeatedly. In like manner, the printing of one line can be accomplished.

The second spring clutch 7 works so as to prevent the rotary shaft 4 from being rotated in the reverse direction. If the second spring clutch 7 is not provided, the ratchet 2 may rotate a little in the reverse direction due to a force in the reverse direction generated when the spring clutch 3 on the boss 1b is loosened. This causes a decrease in precision of location of the type elements. If the second spring clutch 7 is arranged such that it is engaged at its one end 7a with the recess 6a in the side plate 6 and tends to tighten if the ratchet 2 is rotated in the reverse direction, as shown, the reverse rotation of the ratchet 2 due to the above-mentioned reverse rotational force can be prevented.

According to the present invention, the drive mechanism consisting of a drive gear can be kept rotating at all times so that it is unnecessary that the motor be started and stopped every time a character is printed. This allows a high-speed type selection and a high-speed printing control. Moreover, a complicated motor control circuit becomes unnecessary so that the manufacturing cost can be reduced to a great extent.

In addition, the transmission of power from the drive mechanism to the type wheel is effected by the drive gear, spring clutches and ratchet only. This permits producing at a low cost miniaturized printers of a small weight having a reduced number of parts.

The present invention is not, of course, limited to the above-described embodiment; it may be modified in various ways within the scope of the appended claims.

What is claimed is:

1. A device for positioning a selected one of a plurality of type elements carried on the circumference of a type wheel in a printing position along a line to be printed, including a ratchet gear connected for rotation with said type wheel, a motor adapted to be driven continuously in one direction during printing along said line, a drive gear connected for rotation continuously with said motor, clutch means including a first spring element connected to said ratchet gear for connecting the torque of said motor to said ratchet gear in a manner normally rotating said ratchet gear in a first direction during rotation of said drive gear by said motor to continuously rotate said type wheel in said first direction but allowing the torque of said motor to be disconnected from said ratchet gear to enable the rotation of said ratchet gear to be stopped, means operated electromagnetically for disconnecting the torque of said motor from said ratchet gear and stopping rotation of said ratchet gear when a selected type element is in a printing position along said line, and means including a second spring element engaged with said ratchet gear for allowing free rotation of said ratchet gear in said first direction but preventing rotation of said ratchet gear in a direction opposite that of said first direction during operation of said stopping means.

2. A device according to claim 1, said drive gear including a central hub and said first spring element being comprised by a coil spring wrapped around said hub.

3. A device according to claim 2, said coil spring having an end portion extending outwardly.

4. A device according to claim 3, said end portion being held by said ratchet gear.

5. A device according to claim 4, said ratchet gear having a boss protruding centrally, said second spring element being comprised by a second coil spring wrapped around said boss in a direction opposite to the windings of said first coil spring.

6. A device according to claim 5, said second coil spring having an end portion extending outwardly.

7. A device according to claim 6, further including means holding only said end portion of said second coil spring in a fixed position.

8. A device according to claim 7, said end portion of said second coil spring being held by a frame portion of the device.

9. A device according to claim 1, further including means for moving said type wheel laterally along its axis of rotation.

10. A device according to claim 1, said stopping means including a solenoid and a lever adapted to engage said ratchet wheel upon activation of said solenoid.

* * * * *